US005366009A

United States Patent [19]

Cornette et al.

[11] Patent Number: 5,366,009

[45] Date of Patent: Nov. 22, 1994

[54] GRAVEL PACK WELL COMPLETIONS WITH AUGER-LINER

[75] Inventors: Holley M. Cornette, Houston; Michael H. Johnson, Spring, both of Tex.

[73] Assignee: Atlantic Richfield Company, Los Angeles, Calif.

[21] Appl. No.: 668,003

[22] Filed: Mar. 12, 1991

[51] Int. Cl.[5] ..... E21B 43/04

[52] U.S. Cl. ..... 166/51; 166/74; 166/205

[58] Field of Search ..... 166/278, 74, 51, 229, 166/205; 175/392, 394

[56] References Cited

U.S. PATENT DOCUMENTS

| | | | |
|---|---|---|---|
| 572,860 | 12/1896 | Brearley | 166/229 |
| 1,080,684 | 12/1913 | Erickson | 166/74 |
| 2,341,237 | 2/1944 | Phipps | 175/394 |
| 2,371,391 | 1/1945 | Haynes | 166/51 |
| 2,513,944 | 7/1950 | Kessler | 166/205 |
| 2,773,673 | 12/1956 | Petersen | 175/394 |
| 4,635,725 | 1/1987 | Burroughs | 166/278 |
| 4,662,447 | 5/1987 | Bolin | 166/278 |

FOREIGN PATENT DOCUMENTS 0151642 6/1980 Germany .

OTHER PUBLICATIONS

Petroleum Production Engineering, L. C. Uren 3rd Ed, McGraw Hill Book Co. N.Y. 1953 pp. 393–494.

*Primary Examiner*—Ramon S. Britts
*Assistant Examiner*—Frank S. Tsay
*Attorney, Agent, or Firm*—Drude Faulconer

[57] ABSTRACT

A gravel pack well tool for use in a gravel pack completion which does not require the circulation of fluids during installation. The gravel is first placed or preset within the completion zone and then the well tool having a auger-liner assembly is lowered and rotated into the preset gravel. The liner assembly is comprised of a fluid-permeable linear surrounded by a torque sleeve which transmits torque from a workstring to a nose sub at the leading edge of the liner assembly. The nose sub has a fish-tail bit thereon to assist the downward movement of the liner assembly into the preset gravel and has passages therein for fluid flow therethrough in the event the assembly becomes stuck in the gravel during installation.

19 Claims, 1 Drawing Sheet

GRAVEL PACK WELL COMPLETIONS WITH AUGER-LINER

DESCRIPTION

1. Technical Field

The present invention relates to gravel pack well completions and in one of its preferred aspects relates to an gravel pack well tool for completing a production or injection well wherein a particulate material (collectively called "gravel") is first positioned or preset within the well adjacent the zone and a fluid-permeable liner assembly is "augered" into place within said preset gravel to form the gravel pack completion.

2. Background Art

In completing wells having production or injection zones which lie adjacent incompetent subterranean formations (i.e. formations formed on an unconsolidated matrix such as loose sandstone or the like) or which lie adjacent formations which have been hydraulically-fractured and propped, serious consideration must be given to the problems of sand control. These problems arise when large volumes of sand and/or other particulate material (e.g. backflow of proppants from a hydraulically-fractured formation) dislodge from the formation and become entrained in the produced formation fluids. These particulate materials are highly detrimental to the operation of the well and routinely cause erosion, plugging, etc. of the well equipment which, in turn, leads to high maintenance costs and considerable downtime of the well.

While many techniques have been proposed for controlling sand production in a well, probably the most widely-used is one which is generically known as "gravel packing". Basically, a gravel pack completion is one wherein a fluid-permeable liner is positioned within the wellbore (open or cased) adjacent the incompetent or fractured zone and is surrounded by aggregate or particulate material (collectively called "gravel"). As known in the art, the gravel particles are sized to block or filter out the formation particulates from the produced fluids while the openings in the liner are sized to block the gravel and removed particulates from flowing into the liner. This two-stage filtration system is commonly known as a "gravel pack".

There are several known techniques for installing a typical gravel pack completion in a wellbore. For example, one such technique involves positioning the fluid-permeable liner in the wellbore and then placing the gravel around the liner to form the gravel pack. Another technique involves placing the gravel in the wellbore first and then driving, rotating, or washing the liner into the gravel to form the gravel pack. For a good discussion of these techniques, see PETROLEUM PRODUCTION ENGINEERING, Oil Field Development, L. C. Uren, Third Edition, McGraw-Hill Book Co., N.Y., 1946, pps. 575–588.

While such techniques have been widely used, they normally require the circulation of fluid during installation. For example, where the liner is positioned first in the wellbore, a slurry of gravel and a carrier fluid may be pumped down and out through a "cross-over" sub into the annulus formed between the liner and the cased wall (cased hole) or the borewall (open hole). The openings in the liner allow only the carrier fluid to flow from the annulus into the liner while the gravel is strained from the fluid and is deposited within the annulus to form the gravel pack. The gravel can also be placed by flowing the gravel directly into the annulus around the liner from the surface or through open-ended tubulars which extend down the wellbore.

Where the gravel is placed in the wellbore first, the liner is lowered on a workstring and is washed or driven into place while fluid is being pumped down the workstring and out the bottom of the liner. This circulating fluid (i.e. jetting action) is necessary to "fluidize" the pre-positioned or preset gravel so that the liner can be lowered into and through the gravel to form the gravel pack. Unfortunately, since the fluid flows through the workstring, the pumping must be stopped each time an additional stand of workpipe must be added to lower the liner further into the gravel. While the pumping is stopped, the gravel settles and in many instances, cannot be adequately "re-fluidized" upon the resumption of pumping to allow any deeper placement of the liner into the gravel.

Since these techniques require the pumping and/or circulation of fluid under pressure during installation, each may experience severe fluid loss problems, especially when used to complete zones adjacent formations having normal or below normal pressures or pressures which are below the hydrostatic pressure of the completion fluids in the wellbore. For example, in placing gravel around a preset liner, the loss of expensive completion fluids to an underpressured formation (i.e. formation having a pressure less than the fluid pressure in the wellbore) can be excessive. The use of known loss-circulation materials in the gravel slurry is limited since such materials severely hinder the placement of the gravel around the liner. Where the gravel is positioned first, the fluid losses during the high pressure jetting required to "fluidize" the preset gravel also can be excessive. In either case, these fluid losses not only result in increased costs due to the loss of the expensive completion fluids, themselves, but also, contribute to severe formation damage in many cases thereby reducing the productivity and/or operational life of the completed well.

Another technique for forming a gravel pack completion involves first placing the gravel in the wellbore adjacent the zone to be completed and then "augering" a fluid permeable liner into place within the pre-positioned gravel; see U.S. Pat. Nos. 2,371,391 and 2,513,944. Also see co-pending U.S. application Ser. No. 07/518,046, filed May 4, 1990 and now U.S. Pat. No. 5,036,920, issued Aug. 6, 1991 (commonly assigned to the present assignee) which preferably utilizes a commercially-available type of liner having an auger blade attached around its periphery to displace gravel upward as the liner is rotated and lowered into the pre-positioned gravel. This allows the liner to be placed into the gravel without the circulation of fluid thereby maintaining the compactness of the pre-positioned gravel in the wellbore.

Unfortunately, many commercially-available liners are not strong enough to withstand the substantial torques required to rotate the liner into the pre-positioned gravel and in some instances, may twist-off or otherwise be damaged during installation. Further, in some installations, since it is desirable not to circulate fluids while installing the liner, substantial resistance is likely to be encountered as the forward end or nose of the liner initially contacts and penetrates the compacted, pre-positioned gravel and is "augered" downward therein.

Still further, in some wells (e.g. underpressed or overpressured wells) fluids in the wellbore may flow into perforations at one end of the liner, through the interior of the liner, itself, and then out the perforations in the opposite end of the liner, thereby establishing an undesirable flow of fluid within the wellbore which can disturb the desired compactness of the pre-positioned gravel. Therefore, it is an object of the present invention to provide an auger-liner assembly which alleviates such problems in this type of gravel pack completions.

DISCLOSURE OF THE INVENTION

The present invention provides a gravel pack well tool having an auger-liner assembly for carrying out gravel pack completions which do not require the circulation of fluids during installation and is especially useful in completing zones which lie adjacent normal or below normal pressured formations. Basically, gravel is first placed within the zone and then the gravel pack well tool of the present invention is lowered and the liner assembly is augered into the preset gravel. Since the auger blade on the liner mechanically displaces the gravel upward and outward as the tool is moved into the gravel, there is no need to circulate fluid through the tool during installation.

More specifically, the present gravel pack well tool is comprised of a workstring having an auger-liner assembly connected to the lower end thereof. The auger-liner assembly, in turn, is comprised of a fluid-permeable liner (preferably a commercially-available liner; e.g. a gravel pack screen). A perforated torque sleeve is snuggly positioned over the liner and has its upper end affixed and secured to the liner by welding or the like. A nose sub is affixed to the lower end of the torque sleeve whereby a substantial amount of any torque applied to the liner will be transmitted to the nose sub through the torque sleeve thereby preventing the liner from twisting off or otherwise being damaged during installation.

An auger blade is secured to and extends along both the torque sleeve and the nose sub. If the workstring includes sections of blank tubulars above the liner assembly, then the auger blade also extends along and is secured to these blank tubular sections. This insures that the liner can be positioned at its desired depth within the pre-positioned gravel.

The nose sub has a "fish-tail" bit secured thereon at its forward or leading edge which is comprised of two spirally-extending blades which are diametrically-opposed on the nose sub. As the well tool is rotated and lowered by the workstring, the bit at the forward end of the tool contacts the preset gravel and assists in easy entry and penetration of the tool into the gravel.

One or more passages are provided through the nose sub which are normally blocked against upward flow by a check valve. However, if the tool should become stuck in the gravel before its reaches its final destination, fluid can be flowed down the workstring to open the valve to allow flow through the passages in the nose sub to free the tool.

To prevent undesirable fluid flow in the wellbore during installation, means (e.g. packer cups) are secured to the workstring at a point above the auger-liner assembly. One set of packer cups is positioned to prevent downward flow in the well while another set of packer cups is positioned to prevent upward flow.

The gravel pack well tool of the present invention provides a sturdy fluid-permeable liner which can withstand the torsional loads generally required to auger the liner into a mass of preset gravel. At the same time, the tool includes means which prevent the undesirable flow of fluid within the wellbore during installation which could otherwise disturb the desired compactness of the gravel pack completion.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
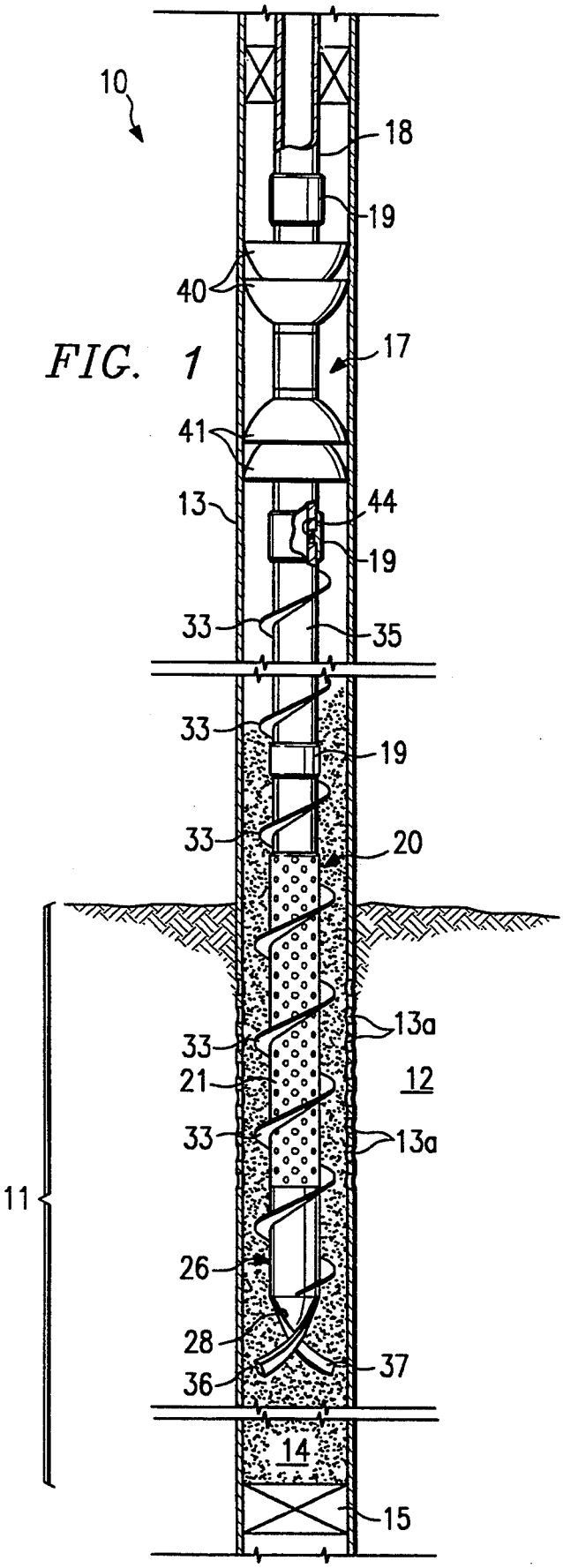
FIG. 1 is an elevational view, partly in section, of a gravel pack completion in accordance with the present invention.

Referring more particularly to the drawings, FIG. 1 illustrates a gravel pack completion in accordance with the present invention as it is being installed in well 10 (e.g. production or injection well). Well 10 has a completion zone 11 therein which lies adjacent to a relatively incompetent formation 12 of the type which is likely to produce sand and/or other particulate material at some time during its operational life. As shown, well 10 has been cased along its length with casing 13 which has been perforated to provide perforations **13*a* adjacent zone 11**. While the present invention is shown and described in relation to completing a zone in a cased, vertical wellbore, it should be understood that the invention can also be used for carrying out completions in open holes as well as in horizontal or deviated wells or to prevent proppant flowback in wells which have been hydraulically-fractured and propped.

In those wells where the wellbore extends past the bottom of completion zone 11, a cement plug, bridge plug or an equivalent-type packer 15 is set in the wellbore at the lower end of zone 11. Sufficient gravel 14 then supplied down the wellbore and onto the top of plug 15 to fill the wellbore through the length of zone 11 which is to be completed. "Gravel" as used herein is intended to include all particulate and/or aggregate materials (e.g. gravel, sand, combinations, etc.) which are used or can be used in gravel pack or fractured completions. As known in the art, the "gravel" particles used in a particular situation are sized so as to block or filter out the particulates which may be produced with the well fluids or which are used to prop open a hydraulically-induced fractures in the formation.

The preset gravel 14 may be introduced into wellbore in any suitable manner, depending upon the actual circumstances involved with a particular completion zone 11. For example, where formation 12 is a relatively low pressured formation, gravel may be flowed down and out of the lower end of a workstring (not shown) which is lowered down the well and positioned above plug 15 or it may be dumped or pumped or bullheaded into the well at the surface and allowed to fall under the influence of gravity. The gravel may be flowed into the wellbore as a substantially dry mixture or as a slurry (mixed with a carrier fluid such as polymer-type, water-based fluid, crude oil, etc.). This type of gravel placement does not require high pressures thereby reducing fluid losses and/or potential damage to the formation. Further, if the situation and formation pressures allow, the gravel may be placed by standard squeeze operations which will insure good filling of perforations 13a with the gravel during the placement of the preset gravel 14 or it may be placed in conjunction with a propped, hydraulic fracture fluid.

After the preset gravel 14 is in place adjacent to zone 11, gravel pack well tool 17 is lowered into the wellbore. As illustrated, gravel pack well tool 17 is comprised of an auger-liner assembly 20 which is connected onto the bottom of workstring 18 by means of release sub 19. If workstring 18 is to be used as the production tubing, release sub 19 can be replaced with a standard connection.

In accordance with the present invention, auger-liner assembly 20 is comprised of a "fluid-permeable liner" 21, which as used herein is meant to be generic and to include any and all types of liners (e.g. screens, slotted pipes, screened pipes, perforated liners, pre-packed screens and/or liners, combinations of same, etc.) which are used or could be used in well completions of this general type. As will be recognized by those skilled in the art, there are presently several known suppliers from whom such "liners" are readily commercially available. The liner may be of a continuous length, as shown, or it may be comprised of a plurality of segments connected by subs or "blanks".

Figure 2:
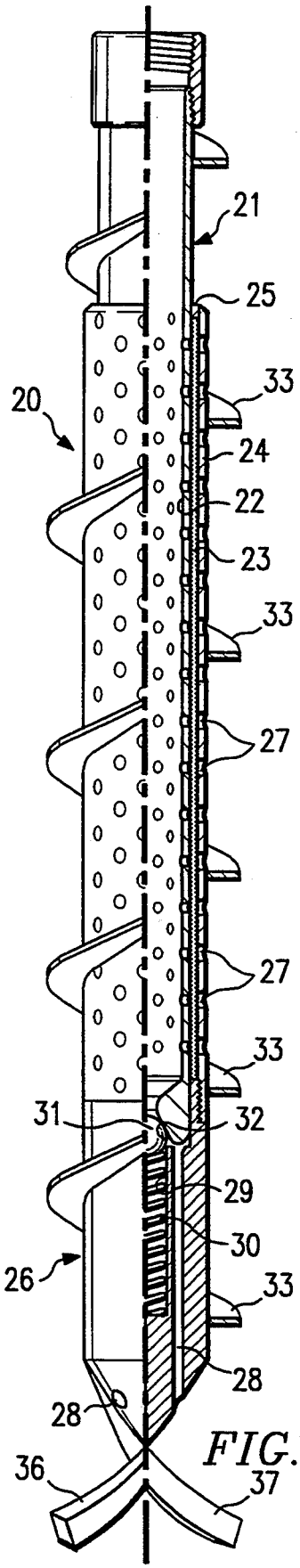
FIG. 2 is an enlarged view, partly in section, of the lower end of the auger-liner assembly of FIG. 1.

Liner 21, as illustrated in the drawings, is a typical fluid-permeable liner of the type known as a "gravel pack screen" and is comprised of an perforated pipe section 22 (FIG. 2) having an outer permeable screen section 23 tightly wound or fitted thereon. This type of commercially-available liner is not normally rotated into place during installation and, in some cases, is likely not to be strong enough to withstand the high torsional loads required to auger the liner into a mass of pre-positioned gravel.

In accordance with the present invention, a relatively heavy-walled torque sleeve 24 is snuggly positioned around liner 21 and over the screen 23 so that there is substantially no clearance between screen 23 and sleeve 24. Sleeve 24 is affixed to perforated pipe section 22 at its upper end by any appropriate means, e.g. welding 25. Sleeve 24 is perforated with openings 27 throughout its length to allow flow between the exterior of the sleeve and the interior of liner 21 whereby the sleeve functions as a permanent part of liner 21 when it is installed in an operable position.

Nose sub 26 is positioned at the lower end of liner 21 and is connected to the lower end of pipe section 22 and sleeve 24 by threads or the like whereby a substantial amount of any torque applied through workstring 18 is transmitted to nose sub 26 through torque sleeve 23. Sub 26 may be solid or preferably it includes one or more longitudinal passages 28 (only one shown in FIG. 2) extending therethrough and has an central, axial recess 29 for receiving spring 30. Ball valve 31 is normally biased upward by spring 30 into engagement with valve seat 32 to prevent upward flow through passages 28 and into liner 22. Other types of check valves (e.g. flapper valves, rupture disks, etc.) can be used in place of ball valve 30 to allow downward flow through passages 28 while preventing upward flow there through for a purpose described below.

Auger blade 33 is affixed along the outer periphery of auger-liner assembly 20 including the exposed portion of pipe section 22, torque sleeve 24 and nose sub 26 and has basically the same configuration as known earth augers in that it is one or more continuous flightings which extend helically around the periphery of assembly 20 and is secured thereto by any appropriate means, e.g. welding. The auger blade 33 extends sufficiently along the length of gravel pack tool 17 to insure that the auger-liner assembly 20 will be properly positioned within the preset gravel 14 to form the desired gravel pack completion. If auger-liner assembly 20 is comprised of segments and blanks or if blank tubular sections 34 (one shown in FIG. 1) above auger-screen 20 are also to be position within gravel 14, auger blade 33 may also extend about the periphery of such blanks.

Affixed to the lower end of nose sub 26 are two, diametrically-opposed, spirally-extending blades 36, 37 which effectively form a "fish-tail" bit at the leading edge of sub 26. Blades 36, 37 may be independent elements which are welded or otherwised secured to the sub 26 or if dual flights are used to form auger blade 33, then blades 36, 37, respectively, may be the terminals or these flights.

To prevent unwanted fluid flow within the wellbore during installation which may disturb the compactness of the pre-positioned gravel 14, packer cups 40, 41 are secured on workstring 18 at a point. above the auger-liner assembly 20 and blank(s) 35. As will be understood by those skilled in the art, one or more packer cups 40 (two shown in FIG. 1) are positioned open-side-up to prevent downward flow in the wellbore (e.g. in underpressred wells) and one or more packer cups 41 (two shown in FIG. 1) are positioned open-side-down to prevent upward flow in the wellbore (e.g. in overpressured wells). By blocking flow in the wellbore, fluid can not flow through the openings at one end of the sleeve, through the liner, itself, and out openings in the opposite end of the sleeve and either into the formation or up the wellbore, as the case may be. Further, commercially-available torque rings 44 are preferably used in making-up connections 45 in the gravel pack well tool 17 to maximize the torsional strength of the tool.

Again, as shown in FIG. 1, preset gravel 14 is placed adjacent completion zone 11 as described above. Well tool 17 is lowered on workstring 18 until it contacts the top of preset gravel 14. Workstring 18 is then rotated at the surface by a rotary table, power sub, or the like (none shown) to rotate auger-screen 20 and "auger" it downward into preset gravel 14. Since the gravel being displaced by the auger-liner 20 as it moves downward is mechanically moved upward and outward along rotating auger blade 22, there is no need to "fluidize" the preset gravel 14 by circulating fluid as was necessary in previous gravel pack completions of this type. This is extremely important, especially where the completion zone is adjacent a normal or underpressured formation in order to prevent substantial fluid losses and/or severe formation damage during installation of the gravel pack. Further, as the gravel is moved upward by auger blade 33, some of this gravel is likely to be forced into perforations 13a in casing 11 thereby improving the overall efficiency of the gravel pack 14.

In the present invention, the torque loads are transmitted to nose sub 26 through torque sleeve 24 and are never applied to screen 23, thereby preventing damage to liner 21 during installation. Further the "fish-tail" bit at the forward or leading edge of sub 26 easily penetrates the pre-positioned gravel 14 and displaces the gravel onto auger blade 33 thereby allowing the auger-liner assembly to be augered into position without the circulation of fluid.

However, if auger-screen 20 should become stuck in the gravel 14 before it has reached its desired position, fluid can be flowed down workstring 18 under pressure to open ball valve 31 and out passages 28 in nose plug 26 to "fluidize" the gravel whereby auger-liner assembly can be lowered the remaining distance in gravel 14 or removed to the surface. When auger-liner assembly 20 is properly positioned within preset gravel 14 to form the gravel pack, a packer 46 (FIG. 1) is set on workstring 18 or sub 19 is released and workstring 18 is withdrawn from the wellbore and is replaced with production tubing or the like and a packer to finish the well completion as will be understood by those skilled in the art.

What is claimed is:

1. An auger-liner assembly for gravel-pack well completions comprising:

a fluid-permeable liner;

a perforated, torque sleeve positioned over said liner and having an upper end affixed to said liner;

a nose sub affixed to the lower end of said torque sleeve whereby a substantially amount of any torque applied to said liner will be transmitted to said nose sub through said sleeve; and an auger blade secured to and extending along said torque sleeve and said nose sub.

2. The auger-liner assembly of claim 1 including:

a bit affixed on said leading edge of said nose sub.

3. The auger-liner assembly of claim 2 wherein said bit comprises:

a fish-tail bit.

4. The auger-liner assembly of claim 3 wherein said fish-tail bit comprises:

two independent spirally-extending blades attached diametrically-opposed at the leading edge of said nose sub.

5. The auger-liner assembly of claim 1 wherein said nose plug includes:

at least one fluid passage therethrough; and means for allowing flow only in one direction through said passage.

6. The auger-liner assembly of claim 5 wherein said means comprises:

a check valve.

7. The auger-liner assembly of claim 5 including:

a bit affixed on said leading edge of said nose sub.

8. The auger-liner assembly of claim 7 wherein said bit comprises:

a fish-tail bit.

9. The auger-liner assembly of claim 8 wherein said fish-tail bit comprises:

two independent spirally-extending, diametrically-opposed blades attached to the leading edge of said nose sub.

10. The auger-liner assembly of claim 7 wherein said fluid-permeable liner comprises:

a inner perforated pipe section; and a screen section tightly fitted over said pipe section; and wherein said torque sleeve is snuggly fitted over said screen section.

11. A gravel pack well tool comprising:

a workstring; and an auger-liner assembly connected at one end to said workstring, said auger-liner assembly comprising:

a fluid-permeable liner;

a perforated, torque sleeve positioned over said liner and having an upper end affixed to said liner;

a nose sub affixed to the lower end of said torque sleeve whereby a substantially amount of any torque applied to said liner will be transmitted to said nose sub through said sleeve; and an auger blade secured to and extending along said torque sleeve and said nose sub.

12. The gravel pack well tool of claim 11 including:

a bit affixed on said leading edge of said nose sub.

13. The gravel pack well tool of claim 12 wherein said bit comprises:

a fish-tail bit.

14. The gravel pack well tool of claim 13 wherein said fish-tail bit comprises:

two independent spirally-extending blades attached diametrically-opposed at the leading edge of said nose sub.

15. The gravel pack tool of claim 11 wherein said nose plug includes:

at least one fluid passage therethrough; and means for allowing flow only in one direction through said passage.

16. The gravel pack well tool of claim 11 including:

a blank tubular section in said workstring above said auger-liner assembly; and wherein said auger blade extends along and is affixed to said blank section.

17. The gravel pack well tool of claim 11 including:

means on said workstring above said auger-liner assembly for preventing flow past said means when said gravel pack tool is in a wellbore.

18. The gravel pack well tool of claim 17 wherein said means for preventing flow comprises:

packer cups secured to said workstring.

19. The gravel pack well tool of claim 18 wherein said packer cups comprise:

at least one packer cup positioned to prevent flow in one direction; and at least one packer cup positioned to prevent flow in the other direction.

* * * * *